US011432687B1

(12) United States Patent
Kowalski

(10) Patent No.: US 11,432,687 B1
(45) Date of Patent: Sep. 6, 2022

(54) APPLICATOR SYSTEM

(71) Applicant: Robert Kowalski, Winnetka, IL (US)

(72) Inventor: Robert Kowalski, Winnetka, IL (US)

( * ) Notice: Subject to any disclaimer, the term of this patent is extended or adjusted under 35 U.S.C. 154(b) by 315 days.

(21) Appl. No.: 15/930,861

(22) Filed: May 13, 2020

Related U.S. Application Data

(60) Provisional application No. 62/857,375, filed on Jun. 5, 2019.

(51) Int. Cl.
*A47K 7/02* (2006.01)
*A47K 7/03* (2006.01)
*A45D 34/04* (2006.01)

(52) U.S. Cl.
CPC ..... *A47K 7/03* (2013.01); *A45D 34/04* (2013.01); *A47K 7/022* (2013.01)

(58) Field of Classification Search
CPC ..... A47K 7/022; A47K 7/024; A47K 7/03
USPC ..... 15/104.94
See application file for complete search history.

(56) References Cited

U.S. PATENT DOCUMENTS 4,020,519 A * 5/1977 Robison ..... A47K 7/024 4/606
4,699,127 A * 10/1987 Schley ..... A47K 7/024 4/606
5,628,083 A * 5/1997 Hayes ..... A47K 7/024 4/606
6,526,618 B1 * 3/2003 Bolton ..... A47K 7/024 15/210.1
8,826,471 B1 * 9/2014 Maddox ..... A47K 3/38 4/557
9,795,257 B1 * 10/2017 June ..... A47K 7/024
2002/0166187 A1 * 11/2002 Rowe ..... A47K 7/024 4/606
2006/0117513 A1 * 6/2006 Ryman ..... A47K 7/024 15/210.1
2010/0175212 A1 * 7/2010 Fitzwater ..... A47K 7/024 15/160
2015/0201815 A1 * 7/2015 Miller ..... A47K 7/024 4/606
2016/0367085 A1 * 12/2016 Klein ..... A47K 7/024

* cited by examiner

*Primary Examiner* — Benjamin R Shaw
(74) *Attorney, Agent, or Firm* — Aronberg Goldgehn Davis & Garmisa

(57) ABSTRACT

The present system relates to an applicator system to assist in the application of material to difficult to reach areas of the human body. The system includes a porous material that is adhered to a water impervious strip. The strip includes additional adhesive that is resistant to water as well as surfactants suitable for use on human skin, for example, bath soaps. The adhesive remains bonded to the strip and sufficiently tacky to allow for users to repeatedly engage and disengage the system from a wall so as to accommodate different sized users.

17 Claims, 8 Drawing Sheets

APPLICATOR SYSTEM

CROSS-REFERENCE TO RELATED APPLICATIONS

This application claims priority to U.S. Provisional Application Ser. No. 62/857,375 filed Jun. 5, 2019, the entirety of which is incorporated herein by this reference for all purposes.

BACKGROUND

There are a number of different application systems on the market designed to assist people in applying material to various parts of the body that may be difficult to reach. For example, there are movable shower heads mounted to a flexible hose and long handled brushes that are meant to provide persons with the ability to scrub and wash their back. However, such devices still require significant shoulder and arm mobility to be utilized. Accordingly, there is a need for users to be able to, with limited mobility, easily reach remote areas of the body and to utilize a system that can be easily installed on a wall without the need for anchors or damage to the wall, and still be adjusted, repeatedly, to accommodate different sized users.

SUMMARY

The present system eliminates the need to articulate the arms and shoulders to reach a person's back. The system utilizes a combination of adhesives and porous material, such as a sponge, that can be repeatedly attached and removed from a shower wall, to adjust the height and position of the sponge to accommodate differently sized users. In that way, a user may attach the system to a wall, apply material, such as soap, to the sponge, and apply the soap to the user's back by simply rubbing against the mounted sponge.

The system incorporates a water impervious strip that is substantially flat on two sides. On one side of the strip there is applied a first adhesive. On the opposite side of the strip there is applied a second adhesive. A porous material, such as a foam sponge, is adhered to the first side by the first adhesive. The second side with second adhesive may be repeatedly adhered to a wall, such as a tiled shower wall. The adhesive bond between the strip, the first adhesive, and the sponge and between the second adhesive, strip, and the wall are such that the application of force to the sponge in a direction away from the adhesive strip releases the adhesion of the strip and second adhesive from the wall. Thus, the system may be pulled away from the wall without separating the strip from the sponge, and because the first adhesive remains on the strip rather than the wall, the system may be reattached to the wall. The adhesives are water proof and non-reactive with surfactants intended for or otherwise suitable for use on the human body, for example, bath soaps such as Dial® and Head and Shoulders®, and non-reactive with lotions intended for or otherwise suitable for use on human skin, such as Vaseline® skin lotion. Thus a surfactant or other fluid, such as a moisturizing lotion, may be applied to the sponge that is adhered to the wall and a user may rub the user's back against the sponge to apply the material to the back without dislodging the system from the wall. Alternative embodiments include sponges that utilize varying textures and stiffness, as well as multi-unit sponges that may be separated and recombine for repeated uses.

Additional embodiments and operations of the applicator system are discussed in further detail in connection with the figures.

DETAILED DESCRIPTION OF EMBODIMENTS

Figure 1A:
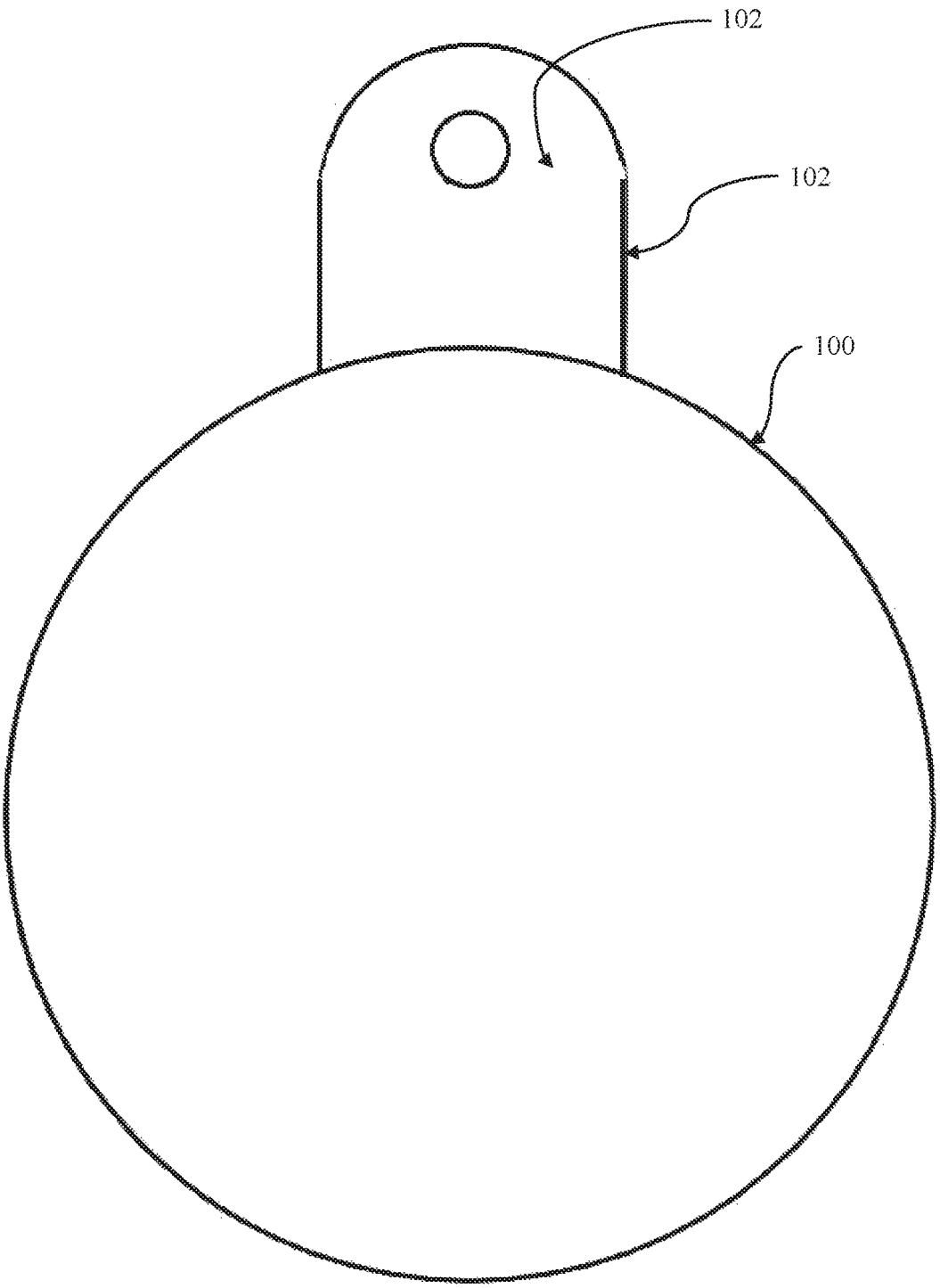
FIG. 1A is a plan view of the front of an embodiment of the present system.

Throughout the specification, wherever practicable, like structures will be identified by like reference numbers. In some figures, components have been omitted for clarity in the drawings. Unless expressly stated otherwise, the term "or" means "either or both" such that "A or B" includes A alone, B alone, and both A and B together. While the present system may be manipulated into a variety of orientations, for ease of reference—and not by way of limitation— structures may be referred to as "front," "back," "side," "top," or "bottom." The drawings provided are not necessarily to scale, and specifically with respect to FIGS. 1C, 2A, and 2C, structures have been exaggerated to allow for ease of reference.

Figure 1B:
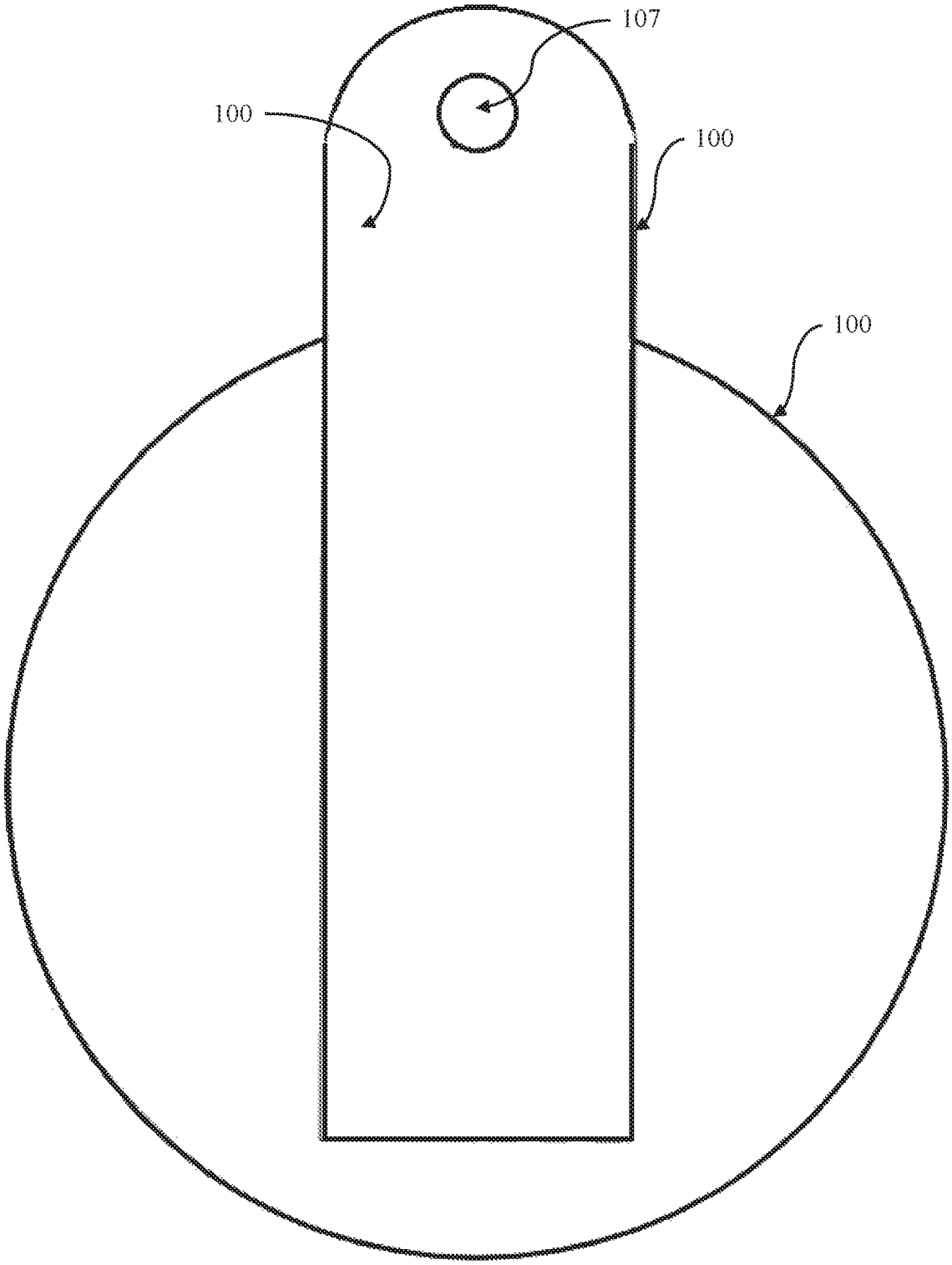
FIG. 1B is a plan view of the back of an embodiment of the present system.
Figure 1C:
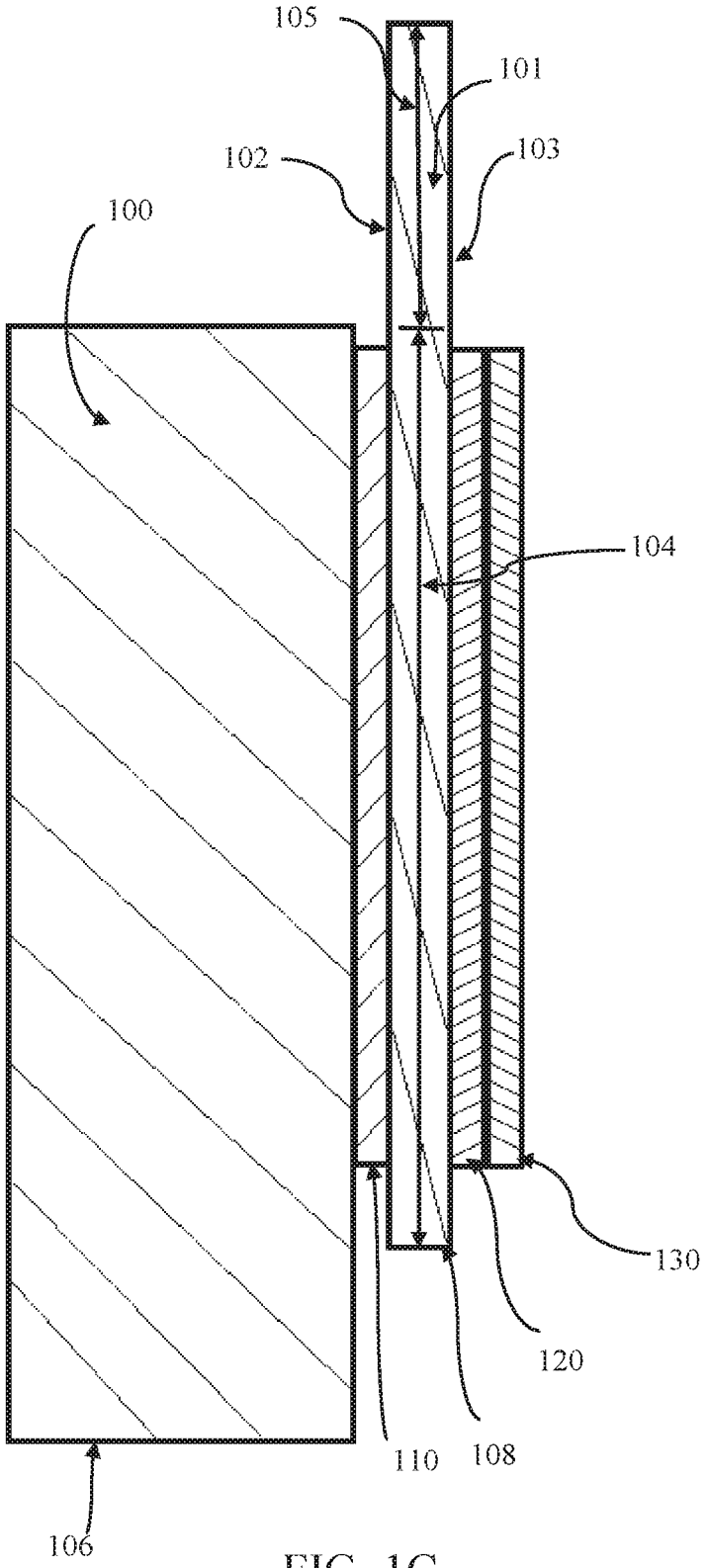
FIG. 1C is an exaggerated plan view of a side of an embodiment of the present system.

FIGS. 1A-1C provide alternate views of an embodiment of the present system. The system includes a porous material 100 connected to a strip 101. The porous material may be a foam material. In one embodiment the porous material is a sponge. The porous material may be uniform in its construction. In alternate embodiments, the porous material may be constructed of one or more layers of differing material. For example, the porous material may include a relatively soft and pliable under layer that readily absorbs and retains a surfactant such as soap, and may include an over layer of comparably stiff material, such as a stiffer foam or bristles that is laminated to the underlayer to provide an exfoliating scrub.

The strip is made of a water impervious material, such as plastic. The strip includes a front side 102 and a back side 103. It includes a lower portion 104 and an extension portion 105. The lower portion is covered by the porous material and terminates at the perimeter of the porous material formed by the outer wall 106. The extension portion extends beyond the outer wall 106 of the porous material 100 to a terminal edge 108 of the strip. The extension portion 105 may further include a hole 107 through the strip 101. In the embodiment shown, the outer wall defines the outer circumference of a circular porous applicator 100, however other shapes of porous applicator could be used. It was found that a circular shape between approximately 6 inches and 8 inches in diameter and between 1.5 inches and 2.5 inches thick provides desirable operational results. The diameter size accommodates an average human's frame and is capable of soaking in sufficient moisture and surfactant to provide desirable cleaning efficacy. It was found that smaller sizes tended to not adequately provide for the application of water and soap, and made it difficult to reach the target area of the back. Also, larger sizes tended to become oversaturated which would needlessly waste soap, become overly heavy, and could take an undesirably long time to dry after use. Additionally, the 6-8 inch size allows for easy manipulation with a single hand when removed from the wall and provides optimal cleaning surface area that targets the area of the back that is the most difficult to reach when attached to the wall.

FIG. 1C is a depiction of the applicator system that has been exaggerated to show the interfaces between various layers of the system. The porous material 100 is bonded to the front side 102 the strip 101 by a first adhesive 110. The first adhesive is applied only in the lower portion 104 of the strip. A second adhesive 120 is bonded in the lower portion 104 of the strip 101 and on the back side 103 of the strip. Bonding in the lower portion allows for the extension portion 105 to remain free of adhesive so that it does not stick to the wall when the applicator system is adhered to the wall. Thus, the extension portion will easily flex away from the wall to provide a reliable grip area to which a pulling force may be applied to disengage the system from a wall after it has been attached. Prior to the initial application of the system to a wall, or for storage and transport, a removable backing 130 may be applied over the second adhesive 120.

In one embodiment, the porous material 100 is a synthetic sponge made of a polyurethane foam. In one embodiment the first adhesive 110 and the second adhesive 120 are different. The first adhesive provides a stronger, permanent bond between the porous material 100 and the strip 101 such that separating the porous material and the strip causes damage to the porous material, the strip, or both such that the porous material would not able to be reattached to the strip with the same efficacy as it originally had been without adding new adhesive material. The second adhesive 120 bonds to the back 103 of the strip 101 (such that it cannot be removed from the strip through the application of a surfactant suitable for use on human skin) but forms a temporary bond with wall surfaces (such as shower tile). That is, when the applicator system is applied to a wall, the second adhesive bonds to the wall to hold the applicator system in place, but through the application of a sufficient pulling force on the applicator system in a direction opposite the wall, the bond between the adhesive 120 and the wall is broken such that the applicator system comes free from the wall and the adhesive 120 remains virtually entirely adhered to strip 120 (that is, the adhesive 120 does not leave sticky or tacky residue on the wall). Accordingly, the applicator system may be applied to smooth and textured walls, unlike suction cups that require perfectly smooth walls, and requires no permanent anchors (such as screw anchors that are drilled into the wall).

Figure 2A:
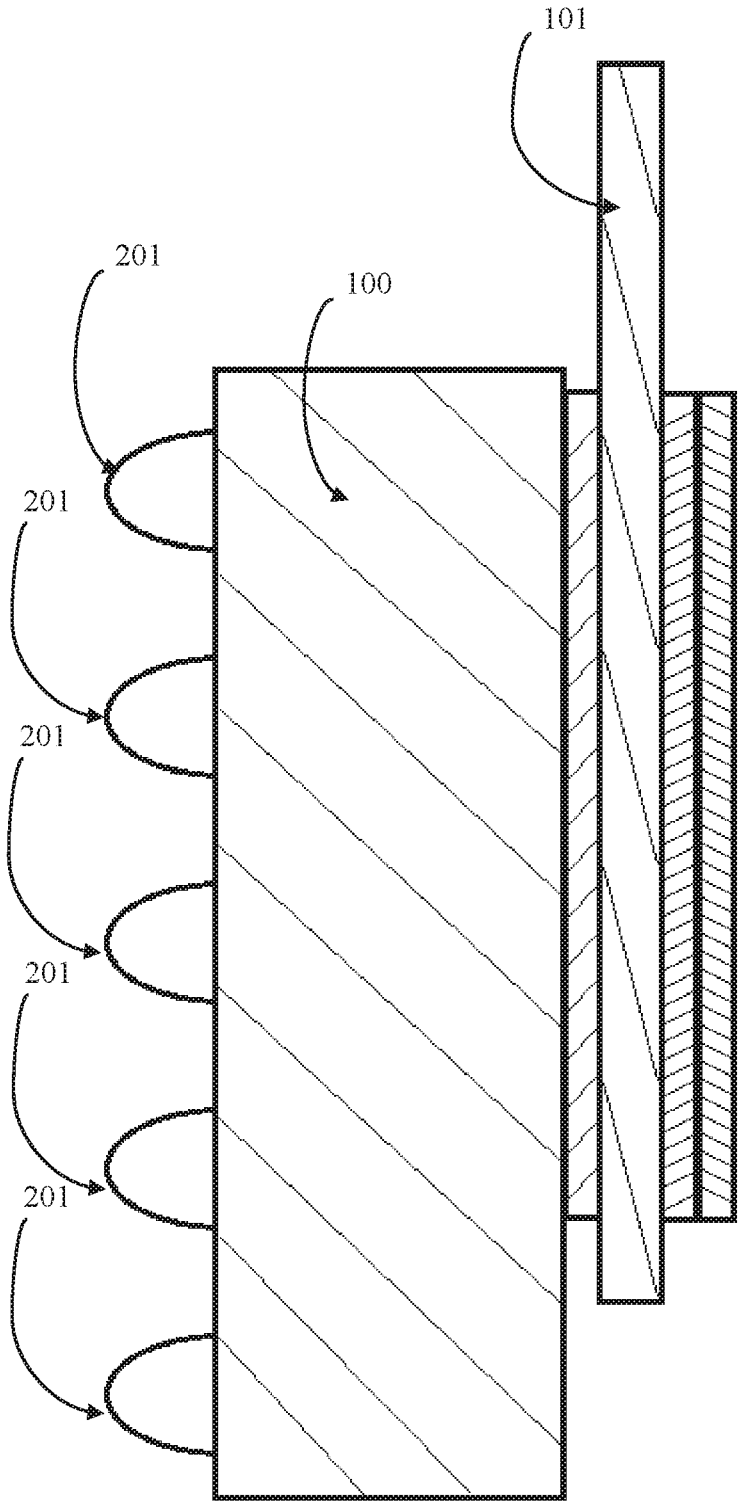
FIG. 2A is an exaggerated plan view of a side of an alternate embodiment of the present system.
Figure 2B:
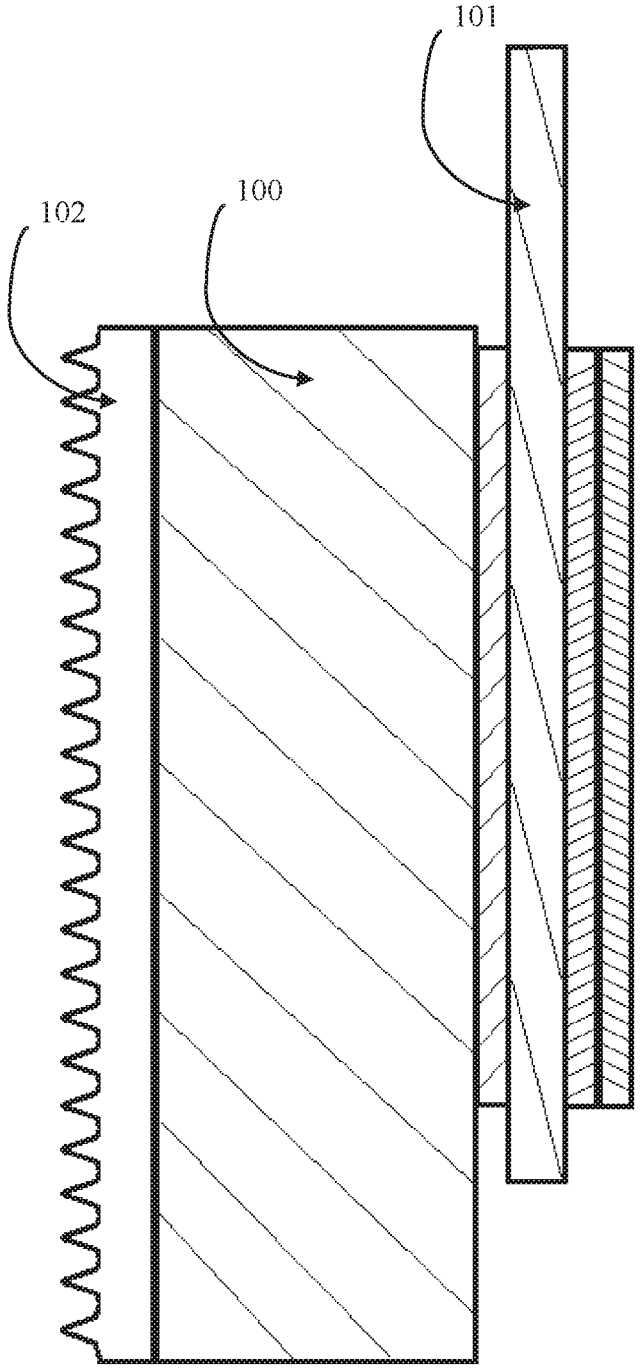
FIG. 2B is an exaggerated plan view of a side of an alternate embodiment of the present system.

FIGS. 2A and 2B depict alternate embodiments of the present system. In FIG. 2A, porous material 100 includes a plurality of protuberances 201. The protuberances 201 may form individual mounds or long ridges across the surface of the porous material. The protuberances 201 may be integrally formed with the porous material 100 and made of the same material. For example, the porous material and protuberances may be formed of eggcrate foam. Alternatively, the protuberances may be bonded to the porous material 100.

In FIG. 2B, a layer of a separate material overlays porous material 100. For example, scrub layer 202 is bonded to porous material 100. While scrub layer 202 may be sufficiently porous to permit the transfer of water and surfactant from the porous material 100 through the scrub layer, in one embodiment the scrub layer is less absorbent than the porous material or non-absorbent. The scrub layer 202 also exhibits a structure that is stiffer than the structure of the porous material. For example, the scrub layer 202 may be formed of bristles or a plastic mesh (for example a polyurethane or polyester mesh) so as to provide an exfoliating scrubbing layer. The layer may cover the entirety of the front surface of the porous material 100 or a portion of the front surface. In one embodiment the scrub layer 202 exhibits a more open structure as compared to the porous material 100. The porous material 100 may exhibit a tight structure that is sturdier than the scrub layer so as to provide greater structural integrity as compared to the scrub layer for bonding with the adhesive to the strip. Additionally, contours in the back of porous material 100 can create contours in the strip that can negatively impact the adhesion of the strip to the wall. To enhance adhesion, the backside of the porous material 100 that is adjacent to the strip is preferably flat.

Figure 3A:
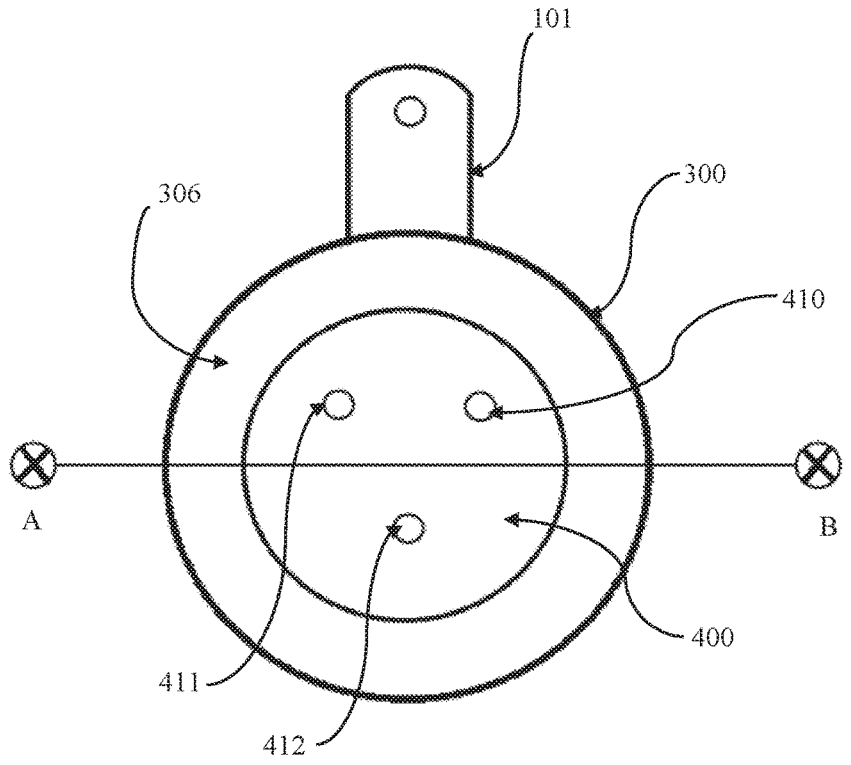
FIG. 3A is a plan view of the front of an alternative embodiment of the present system.
Figure 3B:
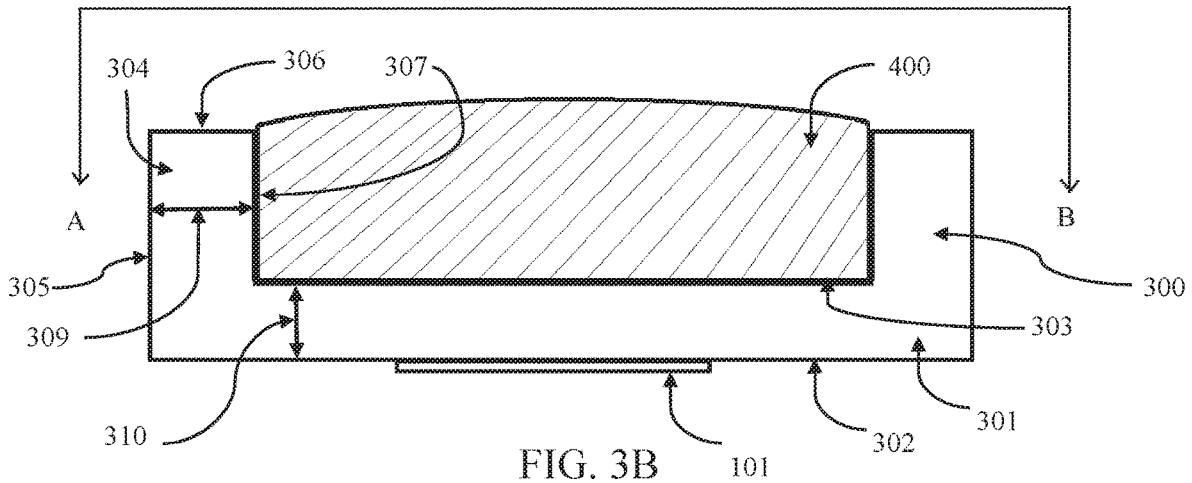
FIG. 3B is cross-sectional view an embodiment of the present system in a first orientation.
Figure 3C:
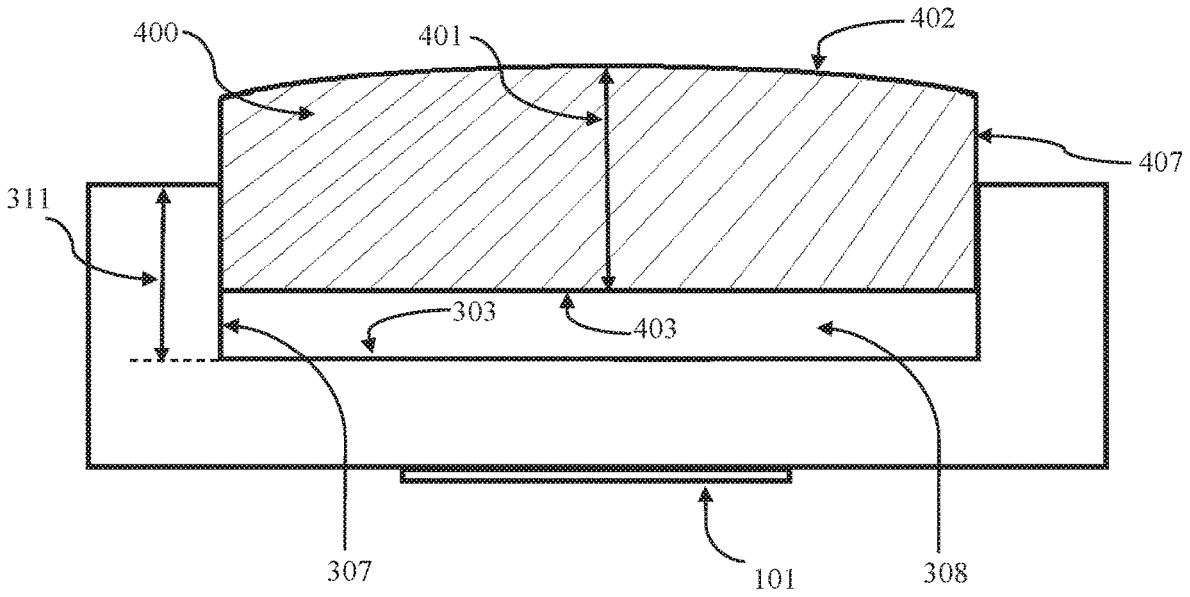
FIG. 3C is a cross-sectional view of an embodiment of the present system in a second orientation.

FIGS. 3A-3C provide depictions of an alternate embodiment of the present system. It includes a strip 101 an outer porous material 300 and an inner porous material 400. For ease of reference, and not limiting, outer porous material will be referred to as outer sponge 300 and inner porous material 400 will be referred to as inner sponge 400. FIG. 3A is a depiction of the front of the embodiment, while FIGS. 3B and 3C are cross-sections of the embodiment along cross-sectional line AB.

Outer sponge 300 includes a base 301, having a back 302 and a seat 303, and a top 306. Strip 101 may be bonded to the back 302 and include adhesives all as described with respect to the embodiment of FIGS. 1A-1C. Outer sponge 300 further includes a raised side wall 304. The raised side wall is formed by a perimeter wall 305 extending from the back 302 to the top 306 and around the perimeter of the outer sponge, and an interior wall 307 extending from the seat 303 to the top 306. The seat and inner wall 307 form a cavity 308 which may be seen in FIG. 3C as well as the embodiment of FIG. 4. Raised side wall 304 further exhibits a wall thickness 309 and the base 301 exhibits a base thickness 310. In one embodiment, the wall thickness is between 0.75 inches and 1.25 inches and the base thickness is between 0.4 inches and 0.75 inches. The respective thicknesses provides suitable structural integrity and resiliency to hold and retain inner sponge 400 even when both the outer sponge and inner sponge are fully saturated with fluid and a lateral of vertical force is applied, such as by a human scrubbing their back on the applicator system, to prevent damage to the outer sponge by tearing at the lamination junction of the first adhesive. It was found that thinner walls would need to be made too stiff, and therefore exhibit an unpleasant feel against the skin, to maintain the necessary holding power and were prone to tearing. Thicker walls unnecessarily increased the material, making the overall applicator system larger than necessary or making the inner sponge smaller than desirable.

The embodiment of FIGS. 3A-3C include inner sponge 400 having a perimeter wall 407 that matches the inner wall 307 of outer sponge 300. Thus, inner sponge 400 is substantially the same size as cavity 308 so as to nest securely within cavity 308. It should be understood that minor variations in the size or shape as between the perimeter wall 407 and the inner wall 307 are acceptable so long as the inner sponge remains nested within the cavity when the applicator system is rotated in three-dimensional space. Inner sponge 400 has a height 401 that is at least equal to height 311 of the cavity (the distance from the seat 303 to the top 306). In the embodiment of FIG. 3A-3C, the height 401 is greater than the height 311 of the cavity such that the front surface 402 of the inner sponge protrudes from the cavity 308. In one embodiment, the height of the inner wall 307 is between 1.3 inches and 1.5 inches and the height 401 of the inner sponge 400 is between 1.3 inches and 2 inches and not more than twice the height of the inner wall.

Inner sponge 400 may also include one or more grips 410, 411, 412. For example, the grips may be cavities or holes formed in the inner sponge. The holes may traverse the entire height 401 of the inner sponge or may be formed partially in the inner sponge. In one embodiment the grips are cavities that are between 0.25 and 0.75 inches in diameter and between 0.5 inches in depth to fully passing through the inner sponge from front to back. In one embodiment, the inner sponge includes five grips, four of which extend in an arc and a fifth which is separated and distanced from the arc so as to correspond to the position of curled fingers and thumb of an average human hand. The grips provide access points such that human fingers may be inserted into the grips and the inner sponge may resiliently deform around the fingers to provide an easily grippable inner sponge that may be inserted and removed from the outer sponge 300. Thus, a person may remove the inner sponge, apply a material such as a surfactant or soap, use the inner sponge to wash easily accessible portions of the body, such as the front torso, arms, and face, and then insert the inner sponge into the outer sponge and wash the hard to reach portions of the body such as the back with the applicator system secured to the wall by the adhesive on strip 101 or porous material 100. A second person may then grip the strip 101, apply a force opposite the wall to remove the applicator system, including the second adhesive which remains on the strip, and reapply the applicator system to an alternate position on a wall using the same second adhesive.

In one embodiment, the top 306 of the outer sponge 300 or the top 401 of the inner sponge 400 include an exfoliating layer such as is described with reference to 202 in FIG. 2B. In one embodiment the bottom 403 of the inner sponge 400 includes an exfoliating layer such as is described with reference to 202 in FIG. 2B. In one embodiment, only one of the top 306, top 401, and bottom 403 includes an exfoliating layer such as is described with reference to 202 in FIG. 2B.

Figure 4:
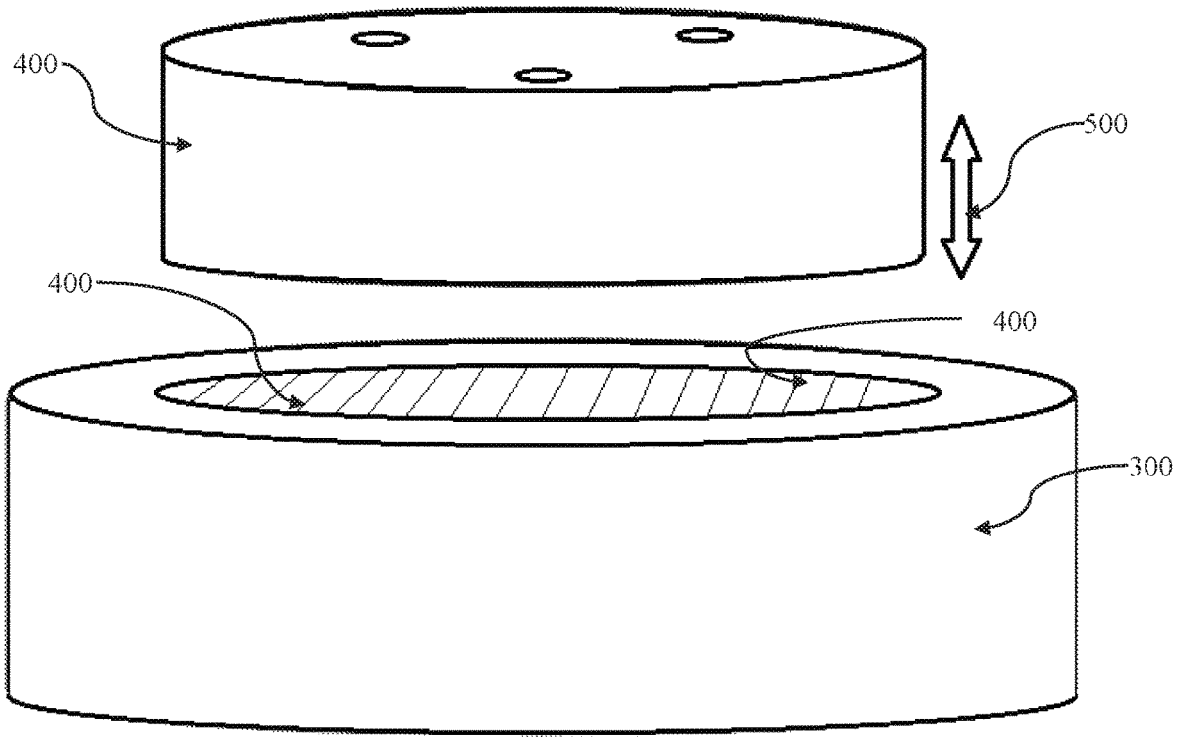
FIG. 4 is a perspective view of an embodiment of the present system.

FIG. 4 is a perspective view of an embodiment. It shows the cavity 308 that is substantially the same size and shape as inner sponge 400 such that inner sponge nests with cavity 308. Inner sponge 400 is not connected to outer sponge 300, but is instead held by outer sponge 300 through frictional engagement. Inner sponge may be disengaged and removed from the outer sponge, and reengaged by inserting the inner sponge into the cavity 308 as shown with respect to arrow 500.

Although the present device and system has been described in terms of various embodiments, it is to be understood that such disclosure is not intended to be limiting. Various alterations and modifications will be readily apparent to those of skill in the art. Accordingly, it is intended that the appended claims be interpreted as covering all alterations and modifications as fall within the spirit and scope of the invention.

What is claimed is:

1. An applicator system comprising:

a porous material having front, a back, and an outer perimeter that defines a shape of the porous material;

a strip having a front side and a back side and comprising a lower portion and an extension portion;

a first adhesive applied to the front side of the strip in the lower portion of the strip;

a second adhesive applied to the back side of the strip in the lower portion of the strip;

wherein the back of the porous material is adhered to the front side of the strip by the first adhesive; and wherein the second adhesive is insoluble in water and soap suitable for use on human skin.

2. The applicator system of claim 1, wherein the first adhesive forms a bond between the porous material and the strip that is stronger than a bond formed by the second adhesive between the strip and a tiled wall.

3. The applicator system of claim 2 wherein the second adhesive remains bonded to the strip when it is engaged with a wall surface such that the strip may engage the wall in a first location by the second adhesive and then disengage from the wall such that the strip and second adhesive may be reengaged with the wall in a second location.

4. The applicator system of claim 1 wherein the lower portion of the strip terminates at the outer perimeter and the extension portion extends from the outer perimeter to a terminal edge of the strip.

5. The applicator system of claim 2, wherein the first adhesive and second adhesive are different.

6. The applicator system of claim 2, wherein a force applied to the porous material in a direction opposite the wall causes the second adhesive to disengage the wall without resulting in damage to the porous material.

7. The applicator system of claim 1, wherein the front of the porous material includes protrusions.

8. The applicator system of claim 1, further comprising a scrub layer laminated to the front of the porous material.

9. The applicator system of claim 8, wherein the scrub layer exhibits a different, stiffer texture than the porous material.

10. The applicator system of claim 1, wherein the porous material includes a base having a seat and an interior wall extending from the seat to the front such that the seat and interior wall form a cavity within the porous material and the seat and interior wall define a size and shape of the cavity.

11. The applicator system of claim 10, wherein the front, outer perimeter, and inner wall define a thickness of a raised side wall of the porous material.

12. The applicator system of claim 11, wherein the base is approximately 0.5 inches thick and the raised side wall is approximately 1 inch thick.

13. The applicator system of claim 11, further comprising a second porous material having a front, back, and a perimeter wall all defining a size and shape of the second porous material;

wherein the size and shape of the second porous material is substantially the same as the size and shape of the cavity.

14. The applicator system of claim 13, wherein the second porous material includes a height, and the height of the second porous material is greater than the distance from the seat to the front of the porous material but not more than twice the distance from the seat to the front of the porous material.

15. The applicator system of claim 13, wherein the second porous material includes a plurality of cavities that are between 0.25 and 0.75 inches in diameter.

16. The applicator system of claim 15, wherein the second porous material includes between two and five cavities.

17. The applicator system of claim 16 wherein four of the cavities are evenly spaced in an arc and a fifth cavity is separated and distanced from the arc.

* * * * *